US005197887A

United States Patent [19]

Davidge et al.

[11] Patent Number: 5,197,887

[45] Date of Patent: Mar. 30, 1993

[54] HIGH DENSITY CIRCUIT CONNECTOR

[75] Inventors: Ronald V. Davidge, Coral Springs; Todd A. McClurg, Boca Raton; Jay H. Neer, Boca Raton; Darryl C. Newell, Boca Raton, all of Fla.; Heinz Piorunneck, Trumbull; Rocco J. Noschese, Wilton; Ronald P. Sidor, Stratford, all of Conn.

[73] Assignee: International Business Machines Corporation, Armonk, N.Y.

[21] Appl. No.: 858,802

[22] Filed: Mar. 27, 1992

[51] Int. Cl.[5] ..... H01R 23/70

[52] U.S. Cl. ..... 439/60; 439/637

[58] Field of Search ..... 439/59-62, 439/630-637; 200/46, 61.19

[56] References Cited

U.S. PATENT DOCUMENTS

| | | | |
|---|---|---|---|
| 3,868,166 | 2/1975 | Ammon . | |
| 3,912,353 | 10/1975 | Kasuya et al. . | |
| 4,077,693 | 3/1978 | Briel, Jr. et al. . | |
| 4,080,027 | 3/1978 | Benasutti . | |
| 4,257,665 | 3/1981 | John et al. | 439/341 |
| 4,270,826 | 6/1981 | Narozny | 439/260 |
| 4,288,140 | 9/1981 | Griffith et al. | 439/267 |
| 4,298,237 | 11/1981 | Griffith et al. | 439/637 |
| 4,314,312 | 2/1982 | Donmoyer | 200/46 |
| 4,319,102 | 3/1982 | Van Cleave et al. | 200/46 |
| 4,376,565 | 3/1983 | Bird et al. . | |
| 4,479,686 | 10/1984 | Hoshino et al. | 439/78 |
| 4,561,710 | 12/1985 | Bovermann | 211/41 |
| 4,715,820 | 12/1987 | Andrews, Jr. et al. | 439/59 |
| 4,734,042 | 3/1988 | Martens et al. | 439/62 |
| 4,795,374 | 1/1989 | Rishworth et al. | 439/634 |
| 4,806,103 | 2/1989 | Kniese et al. | 439/60 |
| 4,824,383 | 4/1989 | Lemke | 439/108 |
| 4,846,734 | 7/1989 | Lytle et al. | 439/637 |
| 4,884,975 | 12/1989 | Pelzl et al. | 439/78 |
| 4,885,482 | 12/1989 | Sharp et al. | 439/62 |
| 4,891,023 | 1/1990 | Lopata | 439/62 |
| 4,892,487 | 1/1990 | Dranchak et al. | 439/260 |
| 4,904,197 | 2/1990 | Cabourne | 439/260 |
| 4,932,885 | 6/1990 | Scholz | 439/79 |
| 4,934,961 | 6/1990 | Piorunneck et al. | 439/637 |
| 5,024,609 | 6/1991 | Piorunneck | 439/60 |

FOREIGN PATENT DOCUMENTS

| | | | |
|---|---|---|---|
| 2642607 | 8/1990 | France | 439/60 |

OTHER PUBLICATIONS

IBM Disclosure, Hinrichsmeyer, vol. 26, No. 12, p. 6476, May-1984.

Research Disclosure, Mason Publications, England, No. 28018, Aug.-1987.

*Primary Examiner*—Neil Abrams

*Attorney, Agent, or Firm*—Ronald V. Davidge

[57] ABSTRACT

An electronic connector is configured to removably receive either a circuit card of a first type, having one row of contacts per side, on an insertion tab adjacent to an insertion edge, or a circuit card of a second type, having two rows of contacts per side. Two rows of spring contacts are provided for this purpose on each side of a central card-receiving slot. Interposing means are also provided to prevent contact between a daughter card of the first type fully inserted in this slot and one of these rows on each side. These interposing means may consist of a slotted interposer structure slid over a portion of the insertion tab of the card, or alternately of a pair of pivotable interposers mounted along the length of the connector, to be pivoted by sections of daughter cards of the first type so that vanes extending from these interposers will push these springs away from the card.

An electronic device, such as a connector of this type, includes solder tails for attachment within holes of a mother board, aligned in several parallel rows. Individual solder tails in each row are displaced by a first distance. Individual solder tails in adjacent rows are displaced by a second distance, which is a submultiple of the first distance less than half the first distance. This second distance may also be a multiple of the first distance divided by the number of rows.

17 Claims, 3 Drawing Sheets

HIGH DENSITY CIRCUIT CONNECTOR

BACKGROUND OF THE INVENTION

1. Field of the Invention This invention relates to electrical connection systems, and, more particularly, to card edge connection systems wherein conductive pads arranged in rows adjacent to an edge of a daughter card are engaged by rows of contacts within a connector mounted on a mother board.

2. Description of the Background Art In the construction of computers and other electronic devices, a need for modularity and design flexibility has made it necessary to build many devices using combinations of various circuits formed on individual printed circuit cards. Electrical connectors provide the means required for the removable assembly of such cards, including the circuit interconnections required among them. Industry trends, such as the miniaturization of electronic components and concurrent reductions in the cost of providing many functions through the use of electronic circuits, are greatly increasing the density of circuit lines on many printed circuit cards, placing similar increased density requirements on electronic connectors.

Many computers today use what is called a "mother board, a "system board," or a "backplane" board, which includes a number of circuits leading to electrical connectors, into which a number of "daughter boards" or "adapter cards" may be plugged to personalize a specific system and to provide particularly for connection to peripheral devices. In some computers, processor circuits on circuit cards are plugged into connectors in this way, as well.

For the sake of simplicity, in the following discussion the assumption is made that a "daughter card" is plugged into a connector attached to a "mother board" by soldering, that the mother board lies horizontally, and that the daughter card extends upward from the connector. It is understood that changes in orientation can easily be made without varying the concepts or hardware involve.

One type of connector which has proven especially effective in the construction of electronic devices is the card edge connector, which is typically configured to removably receive an edge of a printed circuit card in a central card-receiving slot. The card includes a single row of conductive pads on each side adjacent to the edge inserted in the connector. The connector includes a single row of flexible spring contacts on each side of the central slot, configured to be deflected outwardly by the insertion of the card and thereafter to make contact with the pads on the card. These contacts extend as solder tails outside a surface of the housing opposite to the central slot, to be fastened by soldering to individual circuits in the mother board. Thus, electrical connections are formed between circuits attached to the conductive pads on the card and circuits within the mother board. Examples of card edge connectors of this type are found in U.S. Pat. No. 3,868,166, which was issued to J. P. Ammon on Feb. 25, 1975, in U.S. Pat. No. 4,795,374, which was issued to P. L. Richworth et al. on Jan. 3, 1989, in U.S. Pat. No. 4,846,734, issued to Lytle on Jul. 11, 1989, and in U.S. Pat. No. 4,891,023, which was issued to J. E. Lopata on Jan. 2, 1990.

Card edge connectors have come into common usage in versions having contact spacings of 0.100 inch, which are used, for example, to connect adapter cards to the mother board of the IBM Personal Computer AT system units, and in versions having contact spacings of 0.050 inch, which are used, for example, to connect adapter cards to the mother board in IBM Personal System 2 system units. Thus, connectors of this kind having a contact spacing of 0.050 inch form the connections of the IBM "Micro Channel" System (trademark of International Business Machines Corporation).

A number of problems are encountered if an attempt is made to meet needs for increased circuit density within connectors by reducing the spacing between contact centers significantly below 0.050 inch. First, the mechanical properties of the contact springs are compromised due to the reduction in cross-sectional dimensions which must occur with such a decrease in spacing. For example, the stiffness of a beam with a square or round cross-section is directly proportional to the fourth power of its thickness, so reducing the thickness of such a beam by one half while maintaining its shape will reduce the stiffness to one-sixteenth of its present value. Second, the effects of dimensional variations due to practical manufacturing processes in connectors and in printed circuit cards make it difficult or impossible, with contact spacings substantially less than 0.050 inch, to assure that connectors will function properly, i.e. that each contact will touch only the adjacent conductive pad on a printed circuit card. Third, contact spacings much closer than 0.050 inch imply serious problems in soldering the contacts to a mother board, particularly if solder attachment is to be made to holes within the board, due to fine-diameter fragile solder tails, inadequate clearances between the hole surfaces and solder tails, and inadequate space among the holes in the mother board to run circuit traces.

For these reasons, many of the connectors used to interconnect large numbers of circuits have more than the two rows of contacts (one per side) allowed by traditional forms of card edge connectors. An example of such a connector is found in U.S. Pat. No. 4,734,042, issued to J. D. Martens et al. on Mar. 29, 1988, in which six rows of electrical contacts, mounted within a structure extending outward from an edge of a card, are attached to the two sides of a card in a single row of tail portions on each side. Also, U.S. Pat. No. 4,9323,885, which was issued to J. P. Scholz on Jun. 12, 1990, describes a connector assembly to be fastened to the edge of a card, extending outward and beyond the card, the assembly consisting of an inner subassembly with two rows of contacts and an outer subassembly with another two rows of contacts.

On the other hand, the use of multiple rows of contacts on each side of a card edge connector, providing contact surfaces along the central card-receiving slot at various distances from the entrance of this slot, together with a corresponding pattern of parallel rows of contact pads on each side of a daughter card, is practical and has been described, for example, in U.S. Pat. No. 4,806,103, which was issued to W. Kniese et al. on Feb. 21, 1989, and in U.S. Pat. No. 4,934,961, which was issued to H. Piorunneck et al. on Jun. 19, 1990.

Where there are different types of hardware that can be interconnected, with the possibility of causing malfunctions or damage if the wrong combinations are chosen, combinations of keys and keyways are often used to prevent misconnections. Typically these combinations are used simply to prevent the connection of certain devices and to assure that connected devices are properly oriented with respect to each other, as described, for example, in U.S. Pat. No. 4,257,665, which was issued to H. John et al. on Mar. 24, 1981, in U.S. Pat. No. 4,376,565, which was issued to P. S. Bird et al. on Mar. 15, 1983, in U.S. Pat. No. 4,715,820, which was issued to H. W. Andrews, Jr. et al. on Dec. 29, 1987, and in U.S. Pat. No. 4,884,975, which was issued to L. Peizl, et al. on Dec. 5, 1989. Key and keyway arrangement can also be used to determine how far a connector is inserted into a board in which it will be soldered, as described in U.S. Pat. No. 4,479,686, which was issued to M. Hoshino et al. on Oct. 30, 1984, or to determine how far a daughter card is inserted into a connector, as described in U.S. Pat. No. 4,934,961 to Piorunneck.

One particular concern with various types of changes to hardware is that of upgradability. In the marketplace, this concern is often expressed as a need to protect the investment of the customer. It is desirable that, when a customer purchases a new system, he should be able to use as much of his old hardware, which can represent a significant investment, as possible. On the other hand, if the desire for this kind of compatibility is allowed to dictate the way a new system is designed, progress often cannot be made toward increasing system function and performance. In the area of electrical connectors, increased function often means that more signal lines will be required, and that connector line densities must be increased. Therefore, it is particularly desirable to provide a means for increasing the number of signal lines through a connector in such a way that both circuit cards having an improvement using more such lines and older circuit cards with fewer lines can be installed.

This type of compatibility is achieved by using the type of connector described in U.S. Pat. No. 4,934,961, to Piorunneck et al., which describes a bi-level card edge connector having two rows of contacts on each side of a central card-receiving slot. A new type of card configured for use with this connector has two rows of conductive pads on each side--a lower row adjacent to the card edge and an upper row adjacent to the lower row. The connector includes several keys extending across the central slot. When this new type of card is inserted into the slot, the keys align with keyway slots in the card, allowing the card to be fully inserted, so that, on each side, an upper row of connector contacts makes electrical connections with an upper row of conductive pads on the card, while a lower row of such contacts makes electrical connections with a lower row of conductive pads on the card. An older type of card, which has only a single row of conductive pads, adjacent to the edge, also lacks these keyway slots, so that such an older card can only be partially inserted, leaving the upper row of connector contacts providing electrical connections with the only row of card conductive pads on each side, while the lower row of connector contacts makes no electrical connections. Thus, the contact density of a card-edge connector is increased while means are provided to allow the use of both cards of the new type, having two rows of conductive pads per side, and of the old type, having only one row of conductive pads per side.

However, the connector and daughter card described in this patent, U.S. Pat. No. 4,934,961 to Piorunneck et al., does not have the advantage of compatibility in the other direction. Since an interconnection has been established wherein certain daughter cards have about twice as many connected circuits as others, and wherein both types of daughter cards can be used with the connector, the additional circuits must be non-essential, while essential circuits are connected through the only row of contact pads in a daughter card of the old type. Since these circuits are connected through the upper rows of connector contacts, these contacts must be the ones connected to essential circuits within the mother board, while non-essential circuits are wired through the lower rows of connector circuits and contact pads. If a card of the new type, having two rows of contact pads on each side, is plugged into a connector of the old type, only the non-essential circuits of the lower rows of pads will be connected with the essential circuits of the only row of contact springs. Thus, while the interconnection system proposed in this patent meets a need for being able to plug a card of an old type into a connector of a new type, it does not meet a need for being able to plug a card of a new type into a connector of an old type.

A number of concerns have arisen with devices having large numbers of terminals to be soldered to a circuit card or mother board. When more than two rows of such terminals are provided, it is necessary to find pathways for conductive traces among outer rows of terminals to reach inner terminals. If the terminals are in the form of solder tails, which are soldered into plated holes in the mother board, these pathways must be found in the surfaces remaining among such holes. It is further necessary to maintain a reasonably large cross-sectional size of the solder tails, avoiding damage in handling and assembly, and to provide reasonable manufacturing tolerances in the location of solder tails in the connector and holes in the mother board. In order to meet these criteria while providing such pathways, the distances between adjacent holes have been increased by staggering adjacent rows so that the individual solder tails in a row are displaced, in the direction of the length of the row, from those in adjacent rows, by half the distance between contacts in a row.

Card edge connectors have been typically built with pairs of contacts on opposing sides of the central card-receiving slot. The solder tails of both contacts in such a pair are formed through a similar distance in the same lateral direction, while the solder tails of both contacts in adjacent pairs are formed through the same distance in the opposite lateral direction. This configuration produces four axial rows of contacts, with a staggered alignment equal to half the distance between solder tails, as described above. Examples of this kind of staggered alignment are found in U.S. Pat. No. 3,868,166 to Ammond, in U.S. Pat. No. 4,846,734 to Lytle, and in U.S. Pat. No. 4,934,961 to Piorunneok et al. This kind of staggered alignment can also be produced by stamping flat contacts so that alternating pairs of contacts have solder tails descending from the right or left side of a base portion, as shown in U.S. Pat. No. 4,715,820 to Andrews Jr. et al.

The use of interposing means to hold contact springs off conductive surfaces of a daughter card is shown in U.S. Pat. No. 4,806,103, to W. Kniese, et al. In accordance with this patent, insulating ribs placed between conductive pads in a lower row, adjacent to the insertion edge of a card, are used to lift contact springs associated with an upper row of such pads, above the first row, off the surface of the first row as the daughter card is inserted in a connector. This feature prevents cross connections between conductive pads of the lower row and connector spring contacts of the upper row if the card is inserted or withdrawn while power is on.

SUMMARY OF THE INVENTION

A connector configured to removably receive a daughter card includes a number of spring contacts extending into an interface area between the daughter card and the connector, means to limit the engagement of the daughter card with the connector, and interposing means to separate certain spring contacts from the interface of the daughter card. In a first version, these interposing means are an insulating shield which can be slid over the interface of the daughter card. In a second version, these interposing means are mounted so that they can be moved into a position in which they cause a separation between certain contacts and the interface with the card, from a position in which this separation does not occur. This motion can occur in response to engaging a certain type of daughter card with the connector.

A connector can be configured with contact springs having two parallel rows of contact surfaces displaced along each side of a central card-receiving slot to receive either of two types of daughter card, where the first type has one row of conductive contact pads on each side of an insertion tab, next to an insertion edge, and the second type has two parallel rows of such pads on each side of the tab, with the first row being adjacent to the insertion edge, while the second row is adjacent to the first row. Circuits in the daughter card and mother board connected by the connector are divided into essential circuits, which are required for the proper functioning of various types of daughter cards which may be plugged into the connector, and non-essential circuits, which are used to provide additional features or improved performance. Essential circuits are routed through the rows of conductive contact tabs closer to the insertion edge of the card and contact springs associated therewith, while non-essential circuits are routed through the other rows of conductive contact tabs and the other contact springs. A interconnection system including this type of connector may also include interposing means to hold contact springs associated with the second rows of contact tabs away from a daughter card of the first type fully inserted within the card-receiving slot, to prevent inadvertent cross connections due to conductive surfaces which would otherwise be contacted by these springs.

In a high-density electronic component, such as a connector with several rows of contacts, solder tails extending from the connector for solder attachment within holes of a mother board are arranged in several parallel rows, with solder tails within each row spaced uniformly by a first distance. Individual solder tails within adjacent rows are spaced from each other in the direction of the length of these rows by a second distance, which is a submultiple of the first distance smaller than half the first distance. This second distance may also be a multiple of the first distance divided by the number of rows.

BRIEF DESCRIPTION OF THE FIGURES

For a fuller understanding of the nature and advantages of the invention, reference should be made to the following detailed description, taken in conjunction with the accompanying drawings, in which.

DESCRIPTION OF THE PREFERRED EMBODIMENTS

Figure 1:
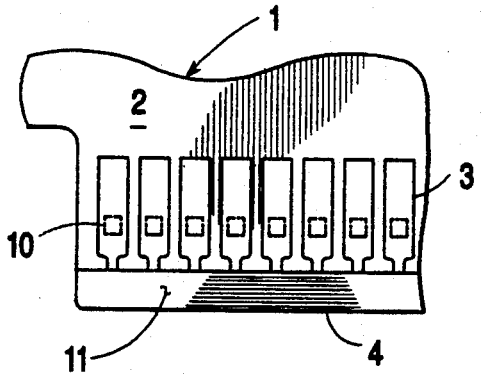
PRIOR ART Figure 1.
FIG. 1 is a partial side elevation of the contact area of a daughter card of a first type, having one row of contact pads per side.
Figure 2:
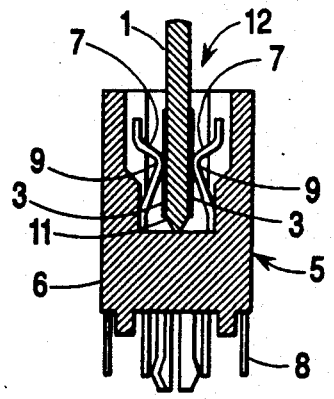
PRIOR ART Figure 2.
FIG. 2 is a transverse cross-sectional elevation through the contact region of a presently-available connector of a first type, configured to accept the daughter card shown in FIG. 1

FIGS. 1 and 2 show a presently-available interconnection configuration, which is used for the removable connection of "Micro Channel" (trademark of International Business Machines Corporation) adapter cards to a planar board, and which is also used for the removable connection of processor cards to the planar board. In each of these applications, the adapter card or processor card will be considered to be a daughter card, while the planar board will be considered to be a mother board. Furthermore, to simplify the discussion of parts relative to direction, a connector will be assumed to be extending upward from a horizontal mother board, with a daughter card being inserted downward from above. It is understood that the various devices which will be discussed would work equally well in other orientations. Referring to FIG. 1, a daughter card, generally designated 1, of a first type includes a generally insulating surface 2 on each side, with a plurality of conductive contact pads 3 aligned thereon in a single row 3 adjacent to an insertion edge 4. These conductive pads 3 are connected to various circuits (not shown) on or within card 1. Referring to FIG. 2, the mating connector, generally designated 5, of a first type includes an insulating body 6 and a single row of spring contacts 7 configured to engage each side of an inserted daughter card 1. Each spring contact 7 includes a solder tail portion 8, extending outside insulating body 6 to be soldered to circuits on or within a mother board (not shown). The curved contact regions 9 of spring contacts 7 determine the contact zones 10 of contact pads in rows 3 on card 1. A beveled surface 11 is included in card 1 on each side between contact pads 3 and insertion edge 4, to aid in the insertion of the card in slot 12 of the connector. In this application, the spacing between center lines of adjacent conductive pads in rows 3 and of adjacent contact springs in rows 7 is 0.050 inch.

Figure 3:
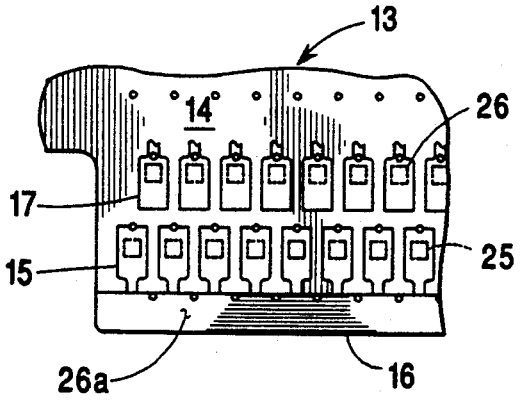
FIG. 3 is a partial side elevation of the contact area of a daughter card of a second type, with extended connections, having two rows of contact pads per side.
Figure 4:
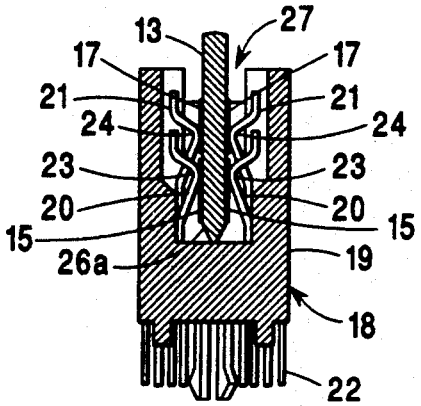
FIG. 4 is a transverse cross-sectional elevation through the contact region of a second type of connector, having two rows of contacts on each side, with a daughter card the second type, shown in FIG. 2, inserted therein.

FIGS. 3 and 4 show an extended type of interconnection configuration, which provides about twice as many circuit connections as those provided by the configuration previously discussed with reference to FIGS. 1 and 2. Referring to FIG. 3, a daughter card of a second type, generally designated 13, with extended connections, includes a generally insulating surface 14 on each side, with a lower row 15 of conductive pads adjacent to the insertion edge 16 and an upper row 17 of pads farther from this edge. Referring to FIG. 4, a connector of a second type, generally designated 18, with extended connections, includes an insulating body 19, with a lower row 20 of spring contacts configured to operate with lower row 15 of conductive pads on an inserted daughter card 13, and an upper row 21 of spring contacts configured to operate with the upper row 17 of such pads. Each spring contact in each row 20 and 21 includes a solder tail portion 22 extending outside insulating body 19 to be soldered to circuits on or within a mother board (not shown). The curved contact regions 23 and 24 of each contact spring in rows 20 and 21 determine, respectively, the contact zones 25 and 26 within the rows 15 and 17 of conductive pads on daughter card 13. A beveled surface 26*a* is included in the daughter card 13 between the contact pads in lower row 15 and the insertion edge 16, to aid in the insertion of the card in slot 27 of the connector.

Both cards of the first type shown in FIG. 1, and connectors of the first type shown in FIG. 2, are widely available from a number of manufacturers, being used in a number of computer models, both in the adapter card application and in the processor card application. Therefore, the extended interconnection system shown in FIGS. 3 and 4 is configured for compatibility with the presently-available system shown in FIGS. 1 and 2; i.e. a connector 18, of a second type with an extended contact pattern, is configured to accept a first-type daughter card 1, and a second type of daughter card 13 is accepted within a first type of connector 5. This compatibility helps preserve the investment that a customer makes in hardware while optimizing his configuration for his application; if he gets a new system, with the extended type of connectors, he can still use his old daughter cards, or if he gets a new type of daughter card he can use it in his old system.

To achieve this kind of compatibility, within second-type daughter card 13 having extended connections, the spacing between contact pad centers in lower rows 15, and the axial location of these pads with respect to features locating the card in a connector are configured to be the same as these parameters in first-type daughter card 1. In the second type of connector 18, curved contact areas 23 of lower rows 20 of spring contacts are configured so that contact is made within contact zones 10 when a first daughter card 1 is fully inserted in this connector 18. Thus, contact zones 25 in daughter card 13 are in the same relative locations as contact zones 10 in daughter card 1, assuring contact between the only row of pads in such a card 1 and the lower row 20 of contacts in connector 18. Furthermore, when a second-type daughter card 13 having extended connections is inserted in a first-type connector 5, the only rows 7 of spring contacts make proper electrical contact with the lower rows 15 of contact pads on the card.

However, when a first-type daughter card 1 is inserted in an extended type of connector 18, the various contact pads 3 of the card may also make contact with various spring contacts within the second rows 21 of the connector, due to the oversized nature of these pads. In a computer bus, or channel, application, such occurrences would cause unwanted electrical cross connections among various lines, which could result in system errors, shut down conditions, and even component damage. The alternative of moving the upper row 17 of contact pads higher on the surface of card 13, with a similar movement of curved contact regions 24 of upper row springs 21, is not available to solve this problem, since, in cards that are presently-available and widely distributed, the areas above contact tabs 3 include vias, traces and various types of electronic hardware, which would cause similar problems with cross connections.

Figure 5:
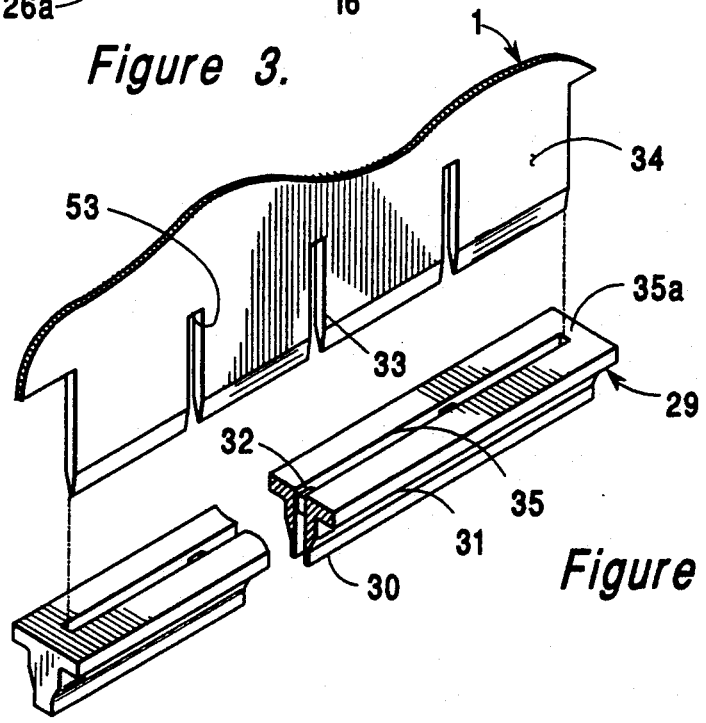
FIG. 5 is an isometric view of an interposer configured to be placed over a tab of a daughter card of a first type in accordance with a first embodiment of this invention.
Figure 6:
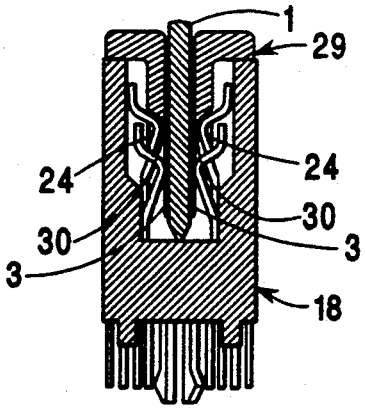
FIG. 6 is a transverse cross-sectional elevation through the contact region of a second type of connector, as shown in FIG. 4, with an interposer as shown in FIG. 5, placed over the insertion tab of the daughter card of a first type, inserted therein.

Therefore, in accordance with the present invention, to prevent occurrences of cross connections, insulative interposing means are provided to hold contacts in the upper rows of a second type of connector out of contact with the surface of the daughter card when a daughter card of the first type is inserted in the connector. A first embodiment of this invention, which is shown in FIGS. 5 and 6, employs an insulating interposing structure, which is slid in place over a portion of the daughter card before it is inserted in a second type of connector. A second embodiment of this invention, which is shown in FIGS. 7 through 10, involves the modification of a second type of connector to include means to push contacts in the upper row out of engagement with the daughter card.

Referring to FIG. 5, in a first embodiment of this invention, an interposing shield, generally designated 29, is provided as a separate piece to be installed, with a daughter card 1 of the first type, when such a card is inserted into an extended type of connector 18. This shield 29 includes, on each side, an interposing edge 30 and a flange 31. The two sides of shield 29 may also be connected by a number of keys 32, which engage slots 33 in the contact portion 34 of card 1. This shield 29 is installed on daughter card 1 with the contact portion 34 of this card extending through interposer slot 35 and with mating card surfaces resting on keys 32 and interposer flange ends 35*a*. Referring to FIG. 6, when the assembly thus formed of the daughter card 1 and the shield 29 is installed in a second type of connector 18, interposing edges 30 move the spring contacts in upper row 17 outward so that these edges 30 are between the surfaces of daughter card 1 and curved contact regions 24 of these spring contact regions. Thus contact between spring contacts in upper row 17 and extensions of lower contact pads in row 3, vias through card 1, or other conductive surface elements of card 1 is prevented.

Thus an interposing structure, attached to the daughter card, covering certain conductive surface elements on the surfaces of the card, is used to determine which contacts electrically engage the card as long as it is inserted. In contrast to this, in the prior art, as described in U.S. Pat. No. 4,806,103, to W. Kniese, et al, interposing structures between contact pads on the surface of the card have been used to provide transient protection from cross connections during the insertion process.

Figure 7:
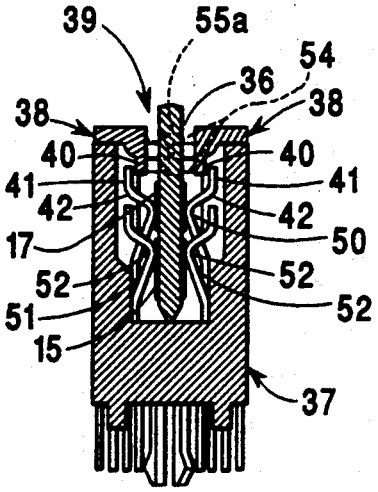
FIG. 7 is a transverse cross-sectional elevation through the contact region of a connector of a second type, built in accordance with the second embodiment of this invention, with an inserted daughter card of the second type, also built in accordance with the second embodiment.
Figure 8:
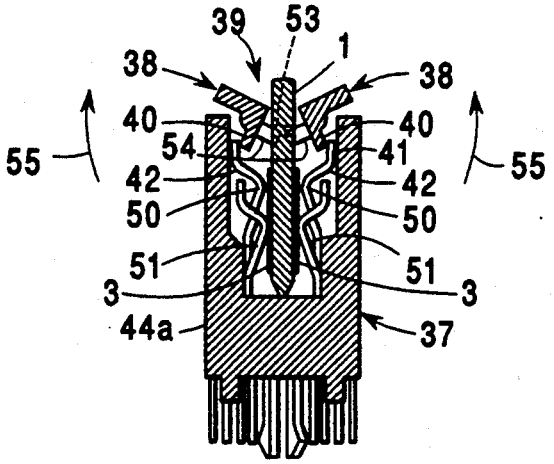
FIG. 8 is a transverse cross-sectional elevation the connector shown in FIG. 7, with an inserted daughter card of the first type.
Figure 9:
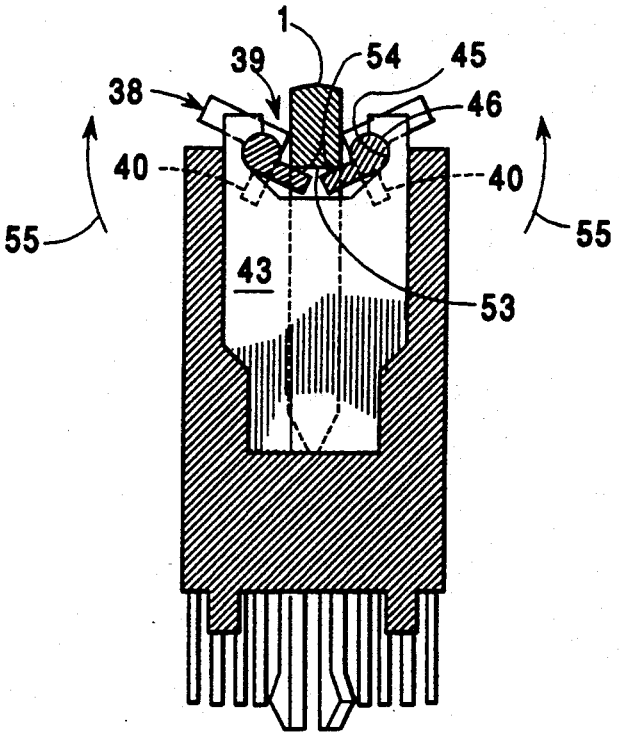
FIG. 9 is a transverse cross-sectional elevation through the support area of the connector and daughter card shown in FIG. 8.
Figure 10:
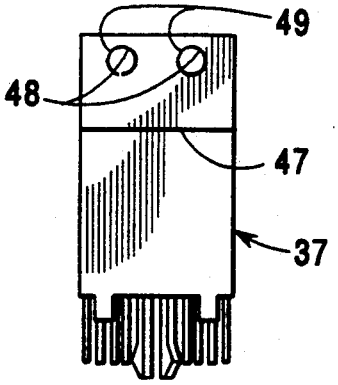
FIG. 10 is an end elevation of the connector shown in FIGS. 7 through 9.

The second embodiment of this invention, which is shown in FIGS. 7 through 10, does not require the insertion of an interposer with a daughter card 1 of the first type, but instead relies on pivotable interposers within an alternative version of a second-type connector to sense differences between types of cards and to move upper-row contacts away from the surfaces of a daughter card 1 of the first type when it is inserted in the connector. FIG. 7 shows a daughter card 36, of a second type having extended contacts, built in accordance with this embodiment, inserted in a second-type connector 37 built in accordance with this embodiment. FIGS. 8 and 9 show a first type of daughter card 1, inserted in connector 37, with FIG. 8 showing the contact region while FIG. 9 shows a support area of the connector. FIG. 10 shows an end elevation of the connector.

Referring to FIGS. 7 and 8, this alternate second type of connector 37 includes a pair of pivotable interposers, generally designated 38, mounted near the top of the connector at either side of a central card-receiving slot 39. Each pivotable interposer 38 includes a number of downward-extending tabs 40 which lie inside the upper tips 41 of upper row contact springs 42. Referring to FIG. 9, the connector 37 includes transverse webs 43, which extend across open sections. These webs 43, which extend upward through slots 33 (shown in FIG. 5) in an inserted daughter card of either type, 1 or 36, strengthen the connector housing **44*a* and provide a pair of arcuate surfaces 45 which engage pivot surfaces 46 of pivotable interposers 38 to provide support for the rotatable mounting of these interposers at various places along their length. Referring to FIG. 10,. connector 37 includes, at each end, an end plate 47 with a pair of pivot holes 48, through which pivot shafts 49 from pivotable interposers 38** extend to provide the mounting of these interposers.

Referring to FIGS. 7 and 8, connector 37 includes, on each side of central card-receiving slot 39, an upper row 42 of contact springs, having curved contact regions 50, and a lower row 51 of contact springs, having curved contact regions 52. While contact springs in both rows 42 and 51 are formed so that, in their free state, they extend into central slot 39 to make contact with the surfaces of a card inserted therein, when a daughter card 1 of the first type is inserted, contact springs in the upper rows 50 are deflected outward, as explained below, to prevent such contact.

Referring to FIG. 9, when a daughter card 1 of the first type is inserted into connector 37, its slot end surfaces 53 contact inward-extending tabs 54 of pivotable interposers 38, causing the rotation of these interposers in the directions of arrows 55. Referring to FIG. 8, this rotation of the interposers moves downward-extending tabs 40 outward, pushing outward on the upper tips 41 of upper-row contact springs 42, moving curved contact surfaces 50 of these springs outward so that contact is not made with the surface of daughter card 1.

Referring to FIG. 7, when a second-type daughter card 36 with extended contacts is inserted into connector 37, pivotable interposers 38 are not rotated, and the contacts in both upper rows 42 and lower rows 51 remain in contact with the upper and lower rows of contact pads on the card, as shown in FIG. 7. This occurs because the slot end surfaces **55*a* of such a card 36 are at a higher level, so that contact is not made between these surfaces 55*a* and inward-extendinq tabs 54 of pivotable interposers 38**.

The use of either embodiment of this invention essentially doubles the number of connections which can be made between a connector and a daughter card, if both the connector and the daughter card of the second types having extended contact patterns, while maintaining full compatibility with presently-available, first-type connectors and daughter cards in the sense that such older examples of hardware can be interchanged with the newer types. In taking advantage of this capability, it is understood that interfaces have been developed using the presently-available components which have been described above, and that these interfaces are commercially successful and widely distributed. The widespread use of such interfaces indicates that the circuits defined in the presently-available interfaces are adequate for a number of important purposes. These circuits are understood to be essential circuits, which are required for both existing and new types of daughter cards and planar boards. The additional circuits are non-essential circuits, which may be used to provide additional functions and to increase performance by providing serial interfaces where parallel interfaces were used before, etc. Thus, the only rows 3 of contact pads on a first type of card 1, and the mating only rows 7 of contact springs on a presently-available type of connector 5 connect essential circuits operating between daughter card 1 and a planar board (not shown) soldered to solder tails 8 of the contact springs.

When a daughter card 1 of a first type is inserted into a second-type connector 18 or 37 having extended contacts, only rows 3 of contact pads are brought into engagement with the lower rows 20 or 51 of contact springs. Therefore, these lower rows of contact springs are connected to circuits which form the mother board side of the essential circuits. When a daughter card 13 or 36, having extended contacts, is inserted into a connector 18 or 37, also having extended contacts, the lower rows of contact tabs engages the lower rows 20 or 51 of contact springs. Therefore, the lower rows of contact tabs on such a daughter card 13 or 36 are connected to the circuits which form the daughter card side of the essential circuits. This way, when such a daughter card 13 or 36 is inserted into a presently-available type of connector, the essential circuits are connected.

Thus, the implementation of either embodiment of the present invention allows the use of first types of cards with second types of connectors, having extended contact structures, and the use of second types of cards, having extended contact structures, with presently-available, first types of connectors, and by implication with present systems. This feature maximizes the protection of the investment of someone now owning systems by eliminating or minimizing the obsolescence of presently-owned components. In particular, an advantage is gained over the interconnection system described in U.S. Pat. No. 4,934,961, to Piorunneck et al., which allows the connection of old types of cards, having only one row of contact pads per side, with new types of connectors, having two rows of contact pads per side, while not permitting the alternative use of new types of cards, having two rows of contact pads per side, with old types of connectors, having one row of contact pads per side.

Thus, the present invention is applied in the prevention of cross connections when a daughter card designed for use with a connector having a single row of contacts per side is instead inserted in a connector having two rows of contacts per side. It is also understood that this invention could be as easily applied to other situations where it is desirable to disable certain connector contacts when certain daughter cards are inserted.

The connector design described in the U.S. Pat. No. 4,934,961, to Piorunneck et al., has been applied in an EISA connector system having a spacing of 0.100 inch between centers of contacts adjacent in each row. The contacts of this connector are brought out the lower surface of the connector housing in four axial rows of solder tails having a spacing between adjacent solder tails of 0.100 inch, with alternating rows staggered axially by 0.050 inch. On the other hand the present invention is intended for use in at least one major application to a connector system having a spacing of 0.050 inch between adjacent contacts. The implementation of a solder tail pattern similar to that of the prior art would result in four axial rows of solder tails having a spacing between centers of 0.050 inch, with alternating rows staggered axially by 0.025 inch. While an aggressive contact density objective of this invention is met at the interface between the daughter card and the connector, a problem of wiring all of the contacts within the connector within the mother board is immediately presented.

Figure 11:
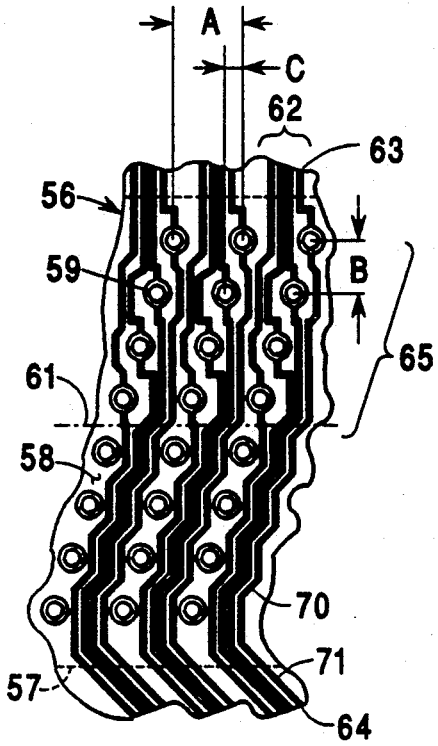
FIG. 11 is a partial plan elevation of a first signal plane within a mother board configured for attachment to a connector.
Figure 12:
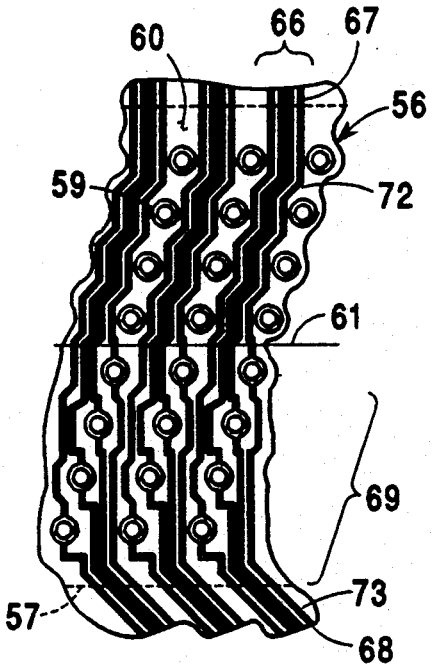
FIG. 12 is a partial plan elevation of a second signal plane within a mother board configured for attachment to a connector.

A solution for this problem will now be discussed with reference to FIGS. 11 and 12. Within a mother board 56, to which a connector 57 is mounted, a first signal plane 58, shown in FIG. 11, contains all of the conductive traces, or lines, going to half of the solder tails 59, while a second signal plane 60, shown is FIG. 12, contains all of the lines going to the other half of the solder tails of the connector. The solder tails 59 of the connector 57 are arranged in eight rows, each of which extends parallel to central (lengthwise) axis 61 of the connector. Within each row, adjacent solder tails are separated by a distance "A," and adjacent rows are separated by a distance "B." Between adjacent rows, solder tails are separated by an axial distance "C," which is equal to one-fourth of distance "A." Due to the repetitive nature of the patterns of lines in signal planes 58 and 60, these patterns can be understood by examining a single group of four lines on each of these planes. For example, in first signal plane 58, a group of four lines 62 is routed from a first area 63 on one side of connector 57 to a second area 64 on the opposite side of the connector, making contact by solder attachment to a group of four solder tails 65. In second signal plane 60, a group of four lines 66 is routed from a first area 67 to a second area 68, making contact by solder attachment to a second group of four solder tails 69. First areas 67 in second signal plane 60 underlies first area 63 in first signal plane 58, and second area 68 similarly underlies second area 64. In first signal plane 58, lines 62 proceed among solder tails 65, making electrical connections with these solder tails, through a channel 70 between adjacent solder tails, and through a path 71, which is angled so that first area 63 and second area 64 are aligned with no displacement from each other in the direction of central axis 61. Similarly, in second signal plane 60, lines 66 proceed through a channel 72, among solder tails 69, where attachments occur, to an angled path 73. The alignment of first areas 63 and 67 with second areas 64 and 68 allows the alignment of multiple parallel connectors on the mother board 56, in a typical bus configuration, with each line running to the same solder tail position on each connector. Thus, the solder tails 59 of connector 57 are configured in a plurality of straight lines angled with respect to the connector axis 61.

Figure 13:
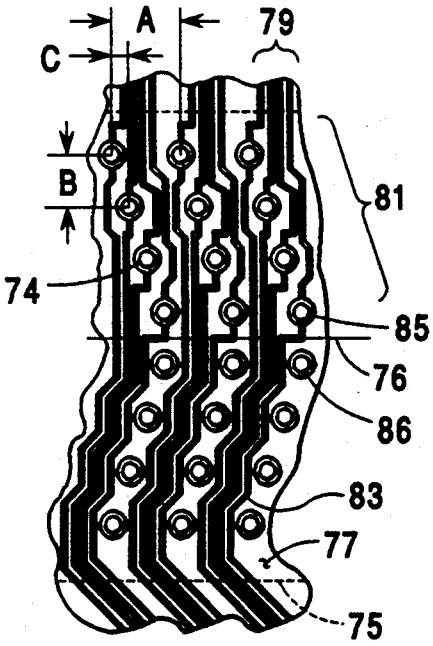
FIG. 13 is a partial plan elevation of a first signal plane within an alternate embodiment of a mother board configured for attachment to a connector.
Figure 14:
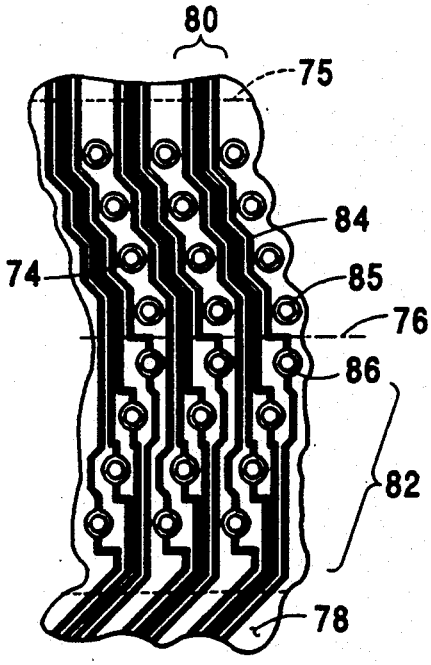
FIG. 14 is a partial plan elevation of a second signal plane within an alternate embodiment of a mother board configured for attachment to a connector.

In an alternate configuration of the connector, as shown in FIGS. 13 and 14, the solder tails 74 of an alternate connector 75 are arranged in a herringbone pattern, which is symmetrical about the connector axis 76. The distances described above, "A," "B," and "C," are maintained in this configuration so that, on first signal plane 77 and second signal plane 78, for example, connections from lines 79 and 80 are made to solder tails 81 and 82, while these lines pass also through channels 83 and 84. The centermost solder tails 85 and 86 are not offset from each other, but are rather aligned.

The offset between solder tails in adjacent rows, by distance "C" as described above, is used to accommodate the spacing among various contacts within the connector 57. The offset between solder tails in adjacent rows, in one direction, is one-fourth the distance between solder tails in the same row. In the opposite direction, the offset between solder tails in adjacent rows is three-fourths the distance between solder tails in the same row. This increased distance on one side provides a pathway through which conductive traces are easily routed. This relationship, where the smaller offset as described above is a submultiple, less than half, of the distance between adjacent solder tails in a row, provides a much better pattern for such routing than the staggered pattern described in background patents, such as U.S. Pat. No. 4,934,961, to Piorunneck et al., where this offset distance is half the distance between adjacent solder tails in a row.

In particular, it has been found that four lines can be routed through the channel, as shown in FIGS. 11 through 14, maintaining a line width, a spacing between adjacent lines, and a spacing between outer lines and hole surfaces in the mother board of 0.15 mm (0.006 inch), a hole diameter of 1.168 mm (0.046 inch), a distance "A" between adjacent holes in a row of 2.54 mm (0.100 inch), a distance "B" between adjacent rows of 1.90 mm (0.075 inch), and an offset distance "C" of 0.635 mm (0.025 inch).

As described in the prior art, such as in U.S. Pat. No. 3,868,166 to Ammond, in U.S. Pat. No. 4,846,734 to Lytle, and in U.S. Pat. No. 4,934,961 to Piorunneck et al., a staggered spacing, between rows of solder tails, equal to half the distance between adjacent solder tails in each row, is in common use. In accordance with the present invention, an unequal spacing is provided by making the staggered spacing a submultiple of the distance between solder tails in each row, where this submultiple is less than one-half this distance between adjacent solder tails. The advantage gained by providing this unequal spacing is that a path for conductive traces is formed along the larger side.

To minimize the number of different types of terminal elements in a component, it is further desirable to make this stagger distance a multiple of the distance between adjacent contacts in a row, divided by the number of rows in the device. When this is done, the shape of terminal elements repeats more quickly.

In the example described above in reference to FIGS. 11 through 14, this stagger distance is a submultiple, one quarter, of the distance between adjacent solder tails in a row. This stagger distance is also two eights, where the number of rows is eight, of the distance between adjacent solder tails.

While this aspect of the invention has been described as applied to an electrical connector, it is understood that many different kinds of electronic devices have multiple rows of solder tails to fasten into a circuit card, and that the kind of staggered pattern described above could be applied with benefit to many other such devices, with many variations in the number of rows, without departing from the spirit and scope of the invention.

In general, although the invention has been described in preferred forms or embodiments with some degree of particularity, it is understood that this disclosure has been made only by way of example, and that numerous changes in the details of construction, fabrication, and use may be made without departing from the spirit and scope of the invention.

What is claimed is:

1. Apparatus for removably receiving a card interface surface of a daughter card and for electrically connecting various conductive portions of said card interface surface with contact terminals extending from said apparatus, said apparatus comprising:

an electrically insulative connector housing having an outer surface and a housing interface surface;

a plurality of spring contacts mounted within said connector body extending individually between said housing interface surface and said contact terminals;

travel limiting means for limiting engagement of said card interface surface with said housing interface surface to a level of full engagement; and interposing means separating certain of said spring contacts from certain of said conductive portions of said card interface surface as said card interface surface is brought into said level of full engagement with said housing interface surface and holding said certain of said spring contacts in separation with said conductive portions of said card interface surface as said card is held at said level of full engagement;

wherein others of said spring contacts extend to electrically engage said card interface surface as said card is brought into and held at said level of full engagement.

2. Apparatus as recited in claim 1, wherein said interposing means comprises an insulative shield slidable over a portion of said card interface surface to cover a first portion of said card interface surface while a second portion of said card interface surface remains exposed to said housing interface surface.

3. Apparatus as recited in claim 1, wherein said interposing means is mounted within said connector body to move between a first position, in which said certain spring contacts are not separated from said certain conductive portions of said card interface, and a second position in which said certain spring contacts are separated from said certain conductive portions of said card interface.

4. Apparatus as recited in claim 3, comprising in addition means for moving said interposing means between said first and second positions in response to engagement between said card interface surface and said housing interface surface.

5. Apparatus as recited in claim 1, wherein:

said housing interface surface comprises a card-receiving slot extending inward from said housing outer surface;

each said spring contact includes a mounting section fastened within housing, a solder tail extending outside of said housing as a contact terminal, a contact section extending within said card-receiving slot, and a flexible section extending between said mounting section and said contact section;

said plurality of spring contacts comprise a first axial row of spring contacts on a side of said card-receiving slot having contact sections at a first distance from said housing outer surface, and a second axial row of spring contacts on said side of said card-receiving slot having contact sections at a second distance from said housing outer surface, said second distance being substantially less than said first distance.

6. Apparatus as recited in claim 5, wherein:

said interposing means separating spring contacts within said second axial row from certain of said conductive portions of said card interface surface; and spring contacts within said first axial row are individually connected to various of said conductive portions of said card interface surface.

7. Apparatus as recited in claim 6, wherein:

each said spring contact within said second axial row comprises in addition a tip section extending toward said outer surface from said contact section; and said interposing means comprises a pivotable interposer mounted to pivot about an axial axis, said pivotable interposer including an insulative vane extending between said card-receiving slot and said tip sections of contacts within said second axial row, and an actuation arm extending into said card receiving slot.

8. An interposing shield for blocking electrical contact between certain surfaces of a tab section of a card and adjacent contacts in a connector when the card is inserted into the connector, said shield comprising:

a pair of opposed edge sections, having a length as required to extend along said tab section and a width as required to cover said certain surfaces, separated by a distance slightly greater than the thickness of said card;

an end section joining said opposed edge sections at each end; and a flange extending outwardly along said edge sections;

wherein said edge sections form continuous surfaces covering said certain surfaces on each side of said tab section and exposing other continuous surfaces on each side of said tab section, when said interposing shield is installed on said tab section.

9. Electrical apparatus for removable insertion into a connector, said apparatus comprising:

a circuit card including a plurality of electronic circuits;

a contact tab extending from an edge of said circuit card to an insertion edge;

a plurality of conductive pads electrically connected to various of said electrical circuits, said contacts aligned in a row on each side of said contact tab, said row being adjacent to said insertion edge; and an insulating, interposing shield extending around a portion of said contact tab displaced away from said insertion edge to expose a portion of each pad in said plurality of conductive pads, said shield including opposed edge sections and flanges extending outward from edges thereof farthest from said insertion edge, each said edge section forming a continuous surface covering a portion of a side of said contact tab.

10. Apparatus for removably receiving either a daughter card of a first type, having a single row of contact pads on each side adjacent to an insertion edge of a contact tab extending from an edge of said card, or a daughter card of a second type, having two parallel rows of contact pads on each side adjacent to an insertion edge of a contact tab extending from a edge of said card, said apparatus comprising:

an electrically insulative connector housing having an outer surface and a central slot for receiving said insertion edge, extending into said connector from said outer surface;

an insertion limiting surface for determining how far a daughter card can be inserted;

a plurality of contact springs, wherein each said contact spring includes a mounting section held within said housing, an attachment section extending from said housing, a contact section facing centrally within said central slot, and a flexible section extending between said contact portion and said mounting portion, wherein said plurality of contact springs comprises a first row of contact springs on each side of said central slot having contact sections axially aligned at a first distance from said outer surface and a second row of contact springs on each side of said central slot having contact sections axially aligned at a second distance from said outer surface, said second distance being substantially less than said first distance; and interposing means for holding said contact springs within said second rows away from surfaces of said daughter card of a first type when said daughter card of a first type is moved to and held against said insertion limiting surface;

wherein contact spring within said first rows individually contact said contact pads within said single rows of contact pads of said daughter card of a first type when said daughter card of a first type is moved to and held against said insertion limiting surface.

11. Apparatus as recited in claim 10, wherein said interposing means comprises an insulating interposer configured to extend around a first portion of said contact tab of said daughter card of a first type, said interposer including opposed edge sections configured to cover an area adjacent to said single row of contact pads on each side while leaving said single row of contact pads on each side exposed, said interposer including flanges extending outwardly along said opposed edge sections.

12. Apparatus as recited in claim 10, wherein said interposing means comprises:

a tip section of each of various said contact springs in said second row, said tip section extending from said contact section toward said outer surface;

a pivotable interposer mounted to pivot axially on each side of said central slot;

a vane extending from each said pivotable interposer adjacent to various of said tip sections; and an actuation arm extending from each said pivotable interposer into said central slot.

13. Electrical apparatus comprising:

a mother board including conductive connector attachment surfaces and both essential and non-essential circuits variously attached to said conductive connector attachment surfaces;

a connector housing containing an outer surface and a central slot for removably receiving a daughter card extending inward from said outer surface; and a plurality of contact springs, wherein each said contact spring includes a mounting portion held within said housing, an attachment portion connected by soldering to a conductive connector attachment surface in said mother board, a contact section facing centrally within said central slot, and a flexible section extending between said contact portion and said mounting portion, wherein said plurality of contact springs comprises a first row of contact springs on each side of said central slot having contact sections axially aligned at a first distance from said outer surface and a second row of contact springs on each side of said central slot having contact sections axially aligned at a second distance from said outer surface, said second distance being substantially less than said first distance;

wherein said essential circuits are connected to contact springs within said first rows and said non-essential circuits are connected to contact springs within said second rows;

wherein said essential circuits are required for proper functioning of various types of said daughter card; and wherein non-essential circuits are used to provide additional features or improved performance.

14. Electrical apparatus as recited in claim 13, comprising in addition interposing means holding said contact sections of said spring contacts within said second rows outwardly away from said central slot as a daughter card is inserted into said central slot and as said daughter card remains in full engagement with said central slot, wherein said contact sections of spring contacts within said first rows extend into said central slot as said daughter card is inserted into said central slot and as said daughter card remains in full engagement with said central slot.

15. Electrical apparatus as recited in claim 13, comprising in addition:

an insertion limiting surface for limiting a level to which a card tab can be inserted into said central slot to a full insertion level;

a daughter card having a tab section inserted into said central slot to said full insertion level, said tab section including, on each side, a row of contact pads aligned with said contact sections in contact springs in said first row; and an insulating interposer around said tab section, extending between surfaces of said daughter card and said contact springs in said second rows when said tab section is inserted into said central slot at said full insertion level, wherein clearance is provided between said insulating interposer and said contact sections of contact springs in said first row.

16. Electrical apparatus as recited in claim 14, comprising in addition:

a tip section of each of various said contact springs in said second row, said tip section extending from said contact section toward said outer surface;

a pivotable interposer mounted to pivot axially on each side of said central slot;

a vane extending from each said pivotable interposer adjacent to various of said tip sections; and an actuation arm extending from each said pivotable interposer into said central slot.

17. An electronic connector comprising:

an electrically insulative connector housing having an outer surface, a central slot extending into said connector from said outer surface; and a plurality of contact springs, wherein each said contact spring includes a mounting section held within said housing, a solder tail section extending from said housing, a contact section facing centrally within said central slot, and a flexible section extending between said contact portion and said mounting portion, wherein:

said plurality of contact springs comprises a first row of contact springs on each side of said central slot having contact sections axially aligned at a first distance from said outer surface and a second row of contact springs on each side of said central slot having contact sections axially aligned at a second distance from said outer surface;

said second distance is substantially less than said first distance;

said solder tail sections extend from said housing aligned in eight rows extending substantially parallel to said central slot;

said solder tails in each said row are displaced by a third distance; and said solder tails in any one of said rows are displaced from those of the adjacent row by a distance of one quarter said third distance along the direction of the rows.

* * * * *